United States Patent [19]

Lyman

[11] Patent Number: 4,789,369

[45] Date of Patent: Dec. 6, 1988

[54] TOY BUILDING BLOCKS WITH MULTIPLE PIVOTING INTERCONNECTIONS

[75] Inventor: Ronald L. Lyman, Rancho Cordova, Calif.

[73] Assignee: Fantasy Toys, Inc., Fair Oaks, Calif.

[21] Appl. No.: 28,441

[22] Filed: Mar. 20, 1987

[51] Int. Cl.[4] ..... A63H 33/08

[52] U.S. Cl. ..... 446/101; 446/104; 446/120; 446/128; 446/117

[58] Field of Search ..... 446/104, 102, 120, 121, 446/97, 101, 116, 108, 115, 124, 125, 128, 85, 117; D21/108

[56] References Cited

U.S. PATENT DOCUMENTS

| | | | |
|---|---|---|---|
| 1,089,499 | 3/1914 | Rockwell | 446/108 X |
| 3,392,480 | 7/1968 | Stubbmann | 446/121 |
| 3,477,167 | 11/1969 | Ach | 446/120 X |
| 3,523,384 | 8/1970 | Adelsohn | 446/97 X |
| 4,169,334 | 10/1979 | Breslow et al. | 446/101 |
| 4,606,732 | 8/1986 | Lyman | 446/104 X |

*Primary Examiner*—Mickey Yu

*Attorney, Agent, or Firm*—Harris Zimmerman; Howard Cohen

[57] ABSTRACT

A toy building block construction includes a lower portion having a generally rectangular solid configuration and an integral upper portion extending therefrom. Extending outwardly from one end of the lower portion are two pair of hinge arms, each pair of arms being spaced apart in laterally opposed, parallel fashion. Each hinge arm includes a detent knob formed on the interior surface thereof confronting the paired, opposing arm. A third pair of identical hinge arms extends upwardly from the top of the upper portion. The end of the lower portion opposed to the one end includes two pair of detent recesses formed in laterally spaced fashion in opposed edges of the lower portion, each detent recess including a detent depression formed therein. Each detent recess is adapted to receive a hinge arm of an adjacent, similar block, with the detent knob of the arm engaged in the detent depression in freely pivoting fashion. A third pair of similarly formed detent recesses are provided in opposed lower edges of the lower portion. The bottom surface of the lower portion may be provided with socket-like receptacles adapted to interconnect with cylindrical projections of similar block systems. The block is provided with an animal-like quadriped form in which the lower portion represents the body, the upper portion is oblate to represent the head, the first two pair of hinge arms are the limbs, and the third pair of hinge arms represents the ears.

15 Claims, 4 Drawing Sheets

TOY BUILDING BLOCKS WITH MULTIPLE PIVOTING INTERCONNECTIONS

BACKGROUND OF THE INVENTION

The concept of interlocking toy building blocks with interconnecting, releasable hinges was first introduced in the prior art in U.S. Pat. No. 4,606,732, issued Aug. 19, 1986 to Ronald Lyman. In addition to interconnection means for stacking such blocks in rigid assembly, this patent discloses the provision of hinge arms extending from one end of each block, and recessed portions at the other end of each block to snap-engage the hinge arms of a similarly formed block. These features expand the structural potential for such building block systems by providing end connections in addition to the vertical stacking capability, and, in particular, by providing pivoting end connections between end-adjacent blocks. Thus it becomes possible to form representations of curved surfaces, to form moving structures which pivot and rotate and, in general, to greatly increase the possibilities for artistic and recreational expression through the medium of building block construction.

SUMMARY OF THE PRESENT INVENTION

The present invention generally comprises a toy building block which is designed to be an improvement and extension of the building block concept disclosed in the U.S. Patent referenced above. The present invention provides multiple pivoting interconnections between blocks, while also providing pivoting interconnections and stackable interconnections with the prior art block system. Furthermore, the invention provides blocks which have a whimsical and appealing quadriped animal form, synergistically combining the multiple pivoting connection functions into the animal features of the block.

The toy building block construction includes a lower portion having a generally rectangular solid configuration and an integral upper portion extending therefrom. Extending outwardly from a first end of the lower portion are two pair of hinge arms, each pair of arms being spaced apart in laterally opposed, parallel fashion. Each hinge arm includes a detent knob formed on the interior surface thereof confronting the paired, opposing arm. A third pair of identical hinge arms extends upwardly from the top of the upper portion. A second end of the lower portion opposed to the first end includes two pair of detent recesses formed in laterally spaced fashion in opposed edges of the lower portion, each detent recess including a detent depression formed therein. Each detent recess is adapted to receive a hinge arm of an adjacent, similar block, with the detent knob of the arm engaged in the detent depression in freely pivoting fashion. A third pair of similarly formed detent recesses are provided in opposed lower edges of the lower portion.

The bottom surface of the lower portion may be provided with socket-like receptacles adapted to interconnect with cylindrical projections of similar block systems. The block is provided with an animal-like quadriped form in which the lower portion represents the body, the upper portion is oblate to represent the head, the first two pair of hinge arms are the limbs, and the third pair of hinge arms represents the ears. The head includes surface features representing the eyes, nose, and mouth, and the side walls of the lower portion include conformal portions extending to the hinge arms to increase the visual impression of limbs of an animal.

DESCRIPTION OF THE PREFERRED EMBODIMENT

Figure 1:
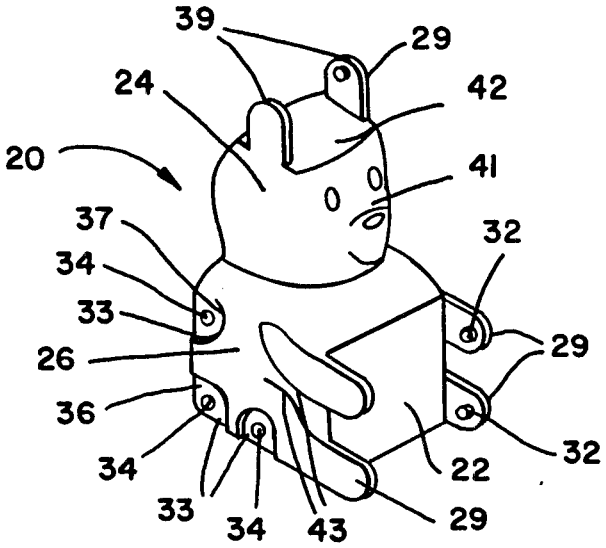
FIG. 1 is a perspective view of the toy building block of the present invention.
Figure 2:
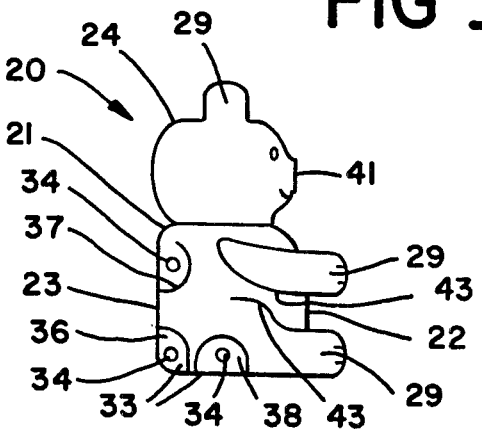
FIG. 2 is a side elevation of the toy building block shown in FIG. 1.
Figure 3:
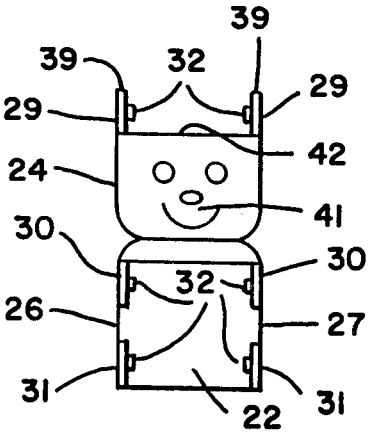
FIG. 3 is a front elevation of the toy building block shown in FIGS. 1 and 2.
Figure 4:
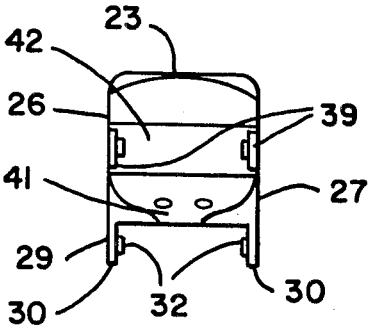
FIG. 4 is a top view of the toy building block shown in FIGS. 1–3.

The present invention generally comprises a toy building block construction which is adapted to be joined to like building blocks in a multiplicity of interconnections, including stacked assembly and hinged, pivoting assemblies of various configurations. Furthermore, the building block of the present invention is provided with an exterior conformation suggestive of an appealing quadriped animal, rather than the uninteresting, generally rectangular forms of prior art building blocks.

With regard to FIGS. 1–5, the toy building block 20 of the invention includes a lower portion 21 having a generally rectangular solid form, and an upper portion 24 having a generally oblate solid form. The upper and lower portions, as well as other structural details described below, are preferably formed in an integral manner in a molded plastic or resin material. The lower portion 21 includes parallel, opposed end walls 22 and 23 which are both substantially planar. Extending orthogonally between the end walls 22 and 23 are another pair of side walls 26 and 27, the latter side walls including surface features in relief to amplify the animal-like appearance of the block.

A salient feature of the present invention is the provision of a plurality of hinge arms 29, arrayed as two pairs 30 and 31 extending from the sides 26 and 27 outwardly past the end wall 22. Each pair is disposed in parallel, laterally spaced arrangement, the pair 30 being disposed directly above the pair 31. Each of the hinge arms includes a thin, planar member extending integrally from the respective side wall 26 or 27, with an arcuate distal end configuration. Each arm 29 also includes a detent knob 32 extending from the interior surface of the arm in confronting relationship with the respective, opposed arm of the pair of arms.

The building block is further provided with a plurality of detent recesses 33 formed in the side walls 26 and 27 and adapted to receive the distal end portions of the hinge arms of like-formed blocks. The detent recesses are each provided with a detent depression 34 dimensioned to receive a detent knob of a hinge arm of another block in snap-engaging, freely pivoting fashion. The detent recesses are arrayed in laterally opposed pairs, a pair 36 being disposed at the conjunction of the lower edges of the side walls 26 and 27 and the edge formed thereby with the end wall 23. A second pair 37 of detent recesses is disposed at the upper extent of the edges formed by the side walls 26 and 27 and the end wall 23. A third pair 38 of detent recesses is formed in the lower edges of side walls 26 and 27, directly adjacent to the detent recesses 36. It may be appreciated that the pairs 36 and 37 of detent recesses are spaced identically to the pairs 30 and 31 of detent arms.

The upper portion 24 of the block is also provided with a pair 39 of arms 29 extending upwardly therefrom in laterally opposed fashion. A planar surface portion 42 extends between the pair 39 to provide clearance between the block 20 and another like block joined to the arm pair 39. The oblate shape of the portion 24 is generally suggestive of the head of an animal, and further includes facial features 41 (eyes, nose, mouth) molded into the surface and directed outwardly (frontwardly) in the same direction as the end wall 22 and the detent arm pairs 30 and 31. The detent arm pair 39 is disposed to represent the ears of an animal, and the pairs 30 and 31 are disposed to represent the limbs of a quadriped animal. To amplify the representation of limbs, the side walls 26 and 27 include surface relief features 43 extending contiguously from the detent arm pairs 30 and 31 to provide the contour and line of limbs of an animal.

Figure 5:
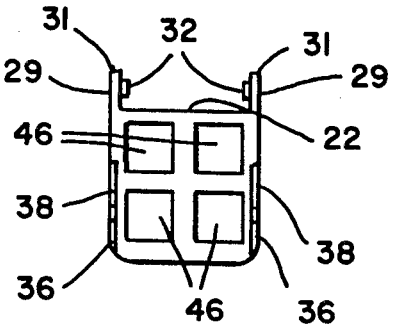
FIG. 5 is a bottom view of the toy building block shown in FIGS. 1–3.
Figure 7:
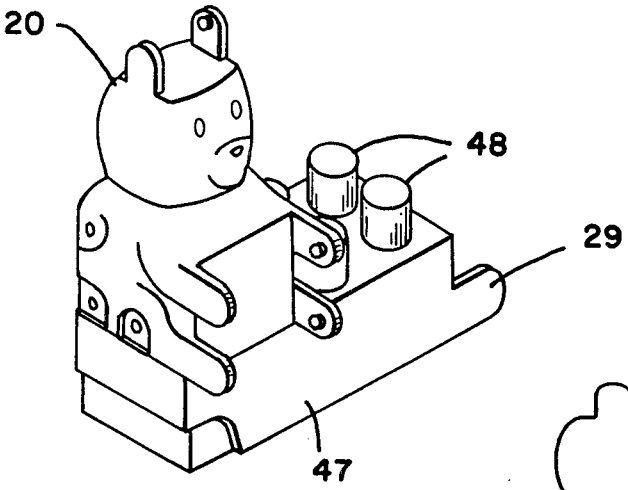
FIG. 7 is a perspective view of the toy building block of the present invention, shown assembled in stacked fashion to a prior art building block.
Figure 8:
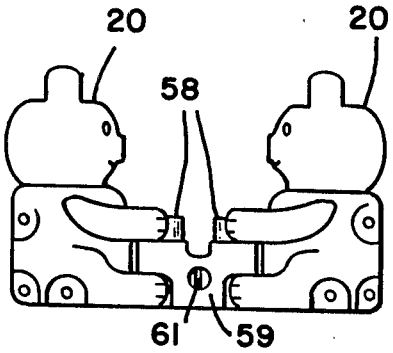
FIG. 8 is a side elevation of two building blocks of the present invention, shown assembled to a prior art building block.

With regard to FIG. 5, the block 20 is also provided with an array of socket-like receptacles 46. The receptacles 46 are dimensioned and arrayed to snap interconnect with cylindrical connection projections, such as those shown in U.S. Pat. No. 4,606,732, referenced above. The receptacles 46 engage the cylindrical projections 48 of a block 47 constructed according to that patent, as shown in FIG. 7. The patent also discloses paired detent arms 29 and detent recesses 33 similar in size and function to those of the present invention, and both inventions are designed to pivotally interconnect by means of the hinge arms and detent recesses.

Figure 6:
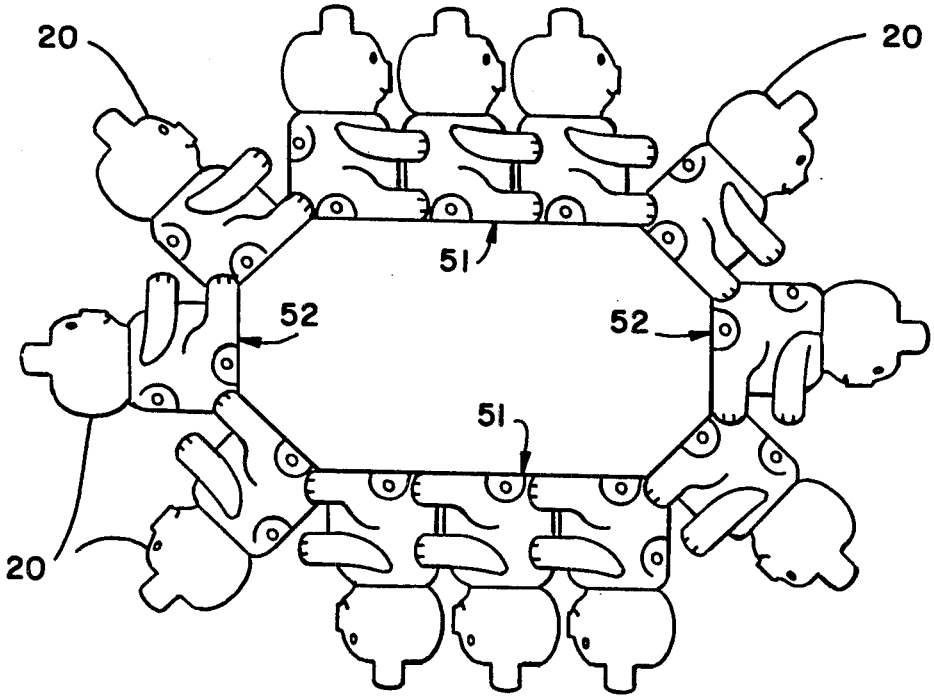
FIG. 6 is a side view of a construction of toy building blocks of the present invention, shown in a hinged loop configuration.
Figure 9:
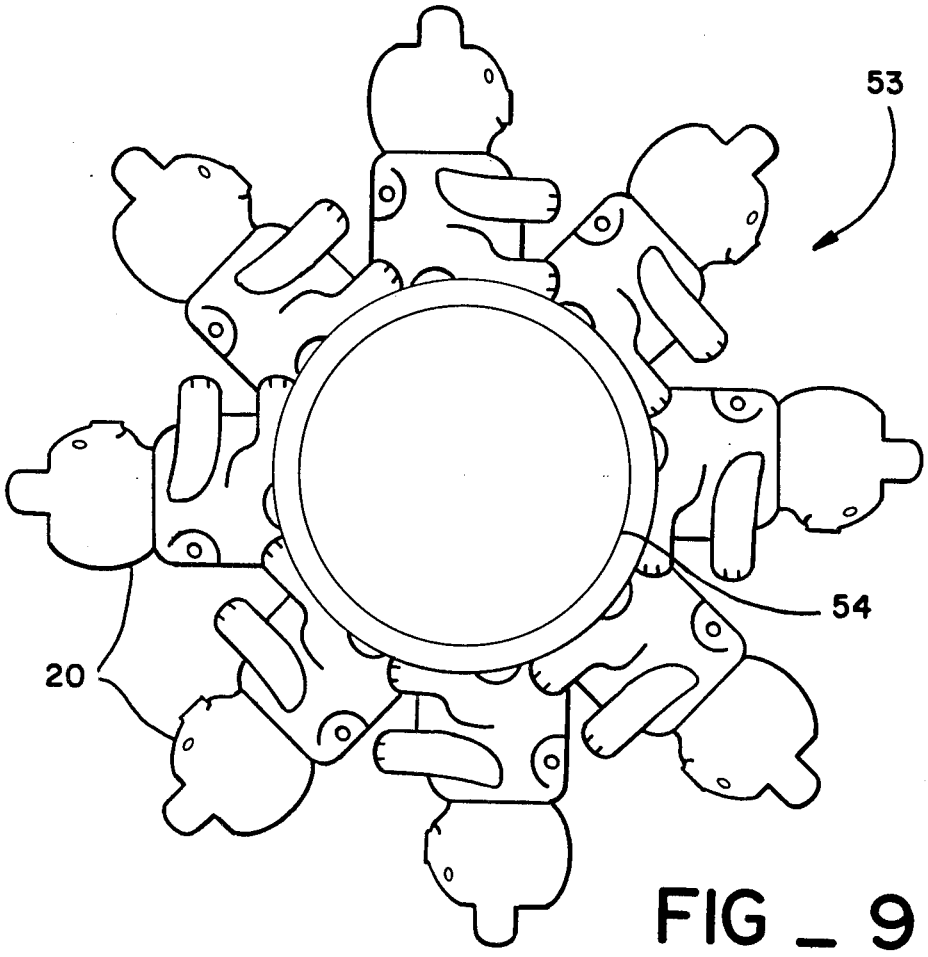
FIG. 9 is a side view of a construction of toy building blocks of the present invention, shown in a hinged ring configuration about a toy wheel.

However, a multiplicity of blocks 20 of the present invention may be interconnected in a large number of configurations, without use of blocks known in the prior art. It should be noted that any of the pairs of arms 29 are adapted to snap-engage any of the pairs of detent recesses 33. Thus the possible modes of interconnection, both fixed and pivoting, are unusually numerous. For example, as shown in FIG. 6, adjacent blocks 20 may be connected with the detent arm pairs 30 and 31 engaged with the detent recess pairs 37 and 36, respectively, and the end walls 22 and 23 in abutting relationship. This mode produces a rigid connection in a linear array 51, as shown in FIG. 6. The detent arm pair 31 may be connected to the recess pair 36 solely, producing a pivoting interconnection and resulting in a flexible chain 52 of blocks, as shown in FIG. 6. It should be noted that a chain formed in this manner may be secured about a pair of blocks to circulate freely thereabout, and that this movement of the blocks will not engage the arm pairs 30 to form a rigid connection. Likewise, with regard to FIG. 9, a circular loop 53 of blocks may be formed about a toy wheel 54 by continuing the pair 31 to pair 36 connection.

Figure 11:
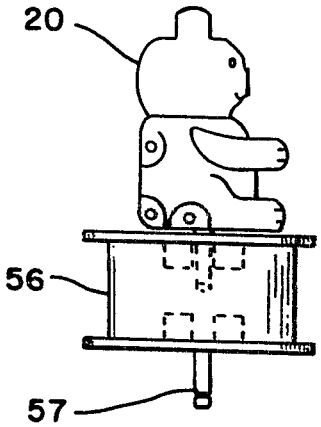
FIG. 11 is a front view of a toy building block of the present invention, shown connected in stacked assembly to a pivot mounting block of a toy wheel construction.
Figure 10:
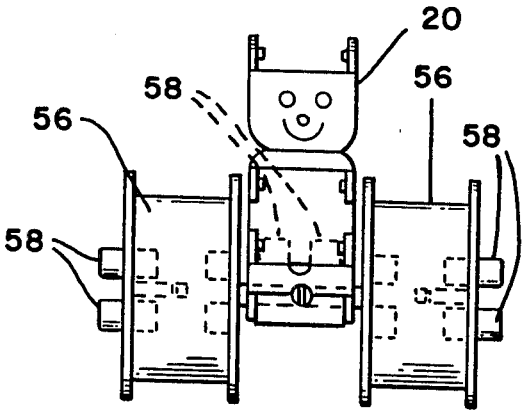
FIG. 10 is a side elevation showing the toy building block of the present invention assembled to a toy wheel assembly.

The block construction 20 of the present invention is also adapted to be used in conjunction with rotatable wheel assemblies disclosed in copending U.S. patent application Ser. No. 892,277, filed Aug. 4, 1986. Such wheel assemblies 56, shown in FIGS. 10 and 11, include a pivot shaft extending axially from one end of the wheel, and a plurality of cylindrical interconnection projections 58 extending from the opposite end of the wheel in an array similar in spacing and layout. It may be appreciated that the receptacles 46 of the block 20 are dimensioned to engage the projections 58 of the wheel 56 in releasable fashion, as shown in FIG. 11. Thus the block 20 may rotate with the wheel 56 about an axis extending upwardly through the block. Also, the referenced patent application discloses a wheel mounting block 59 which includes a plurality of bores 61 extending into side walls thereof and dimensioned to engage one or more pivot shafts 57 of at least one of a pair of wheels 56. The block 59 also includes a plurality of cylindrical projections 58, which the receptacle 46 may engage. The block 20 is thus joined to a wheeled structure capable of rolling translation, as shown in FIG. 10. It may be appreciated that many other combinations may be made of the present invention 20 and prior art building block construction, limited only by the imagination of the builder and the number and variety of blocks available.

Figure 12:
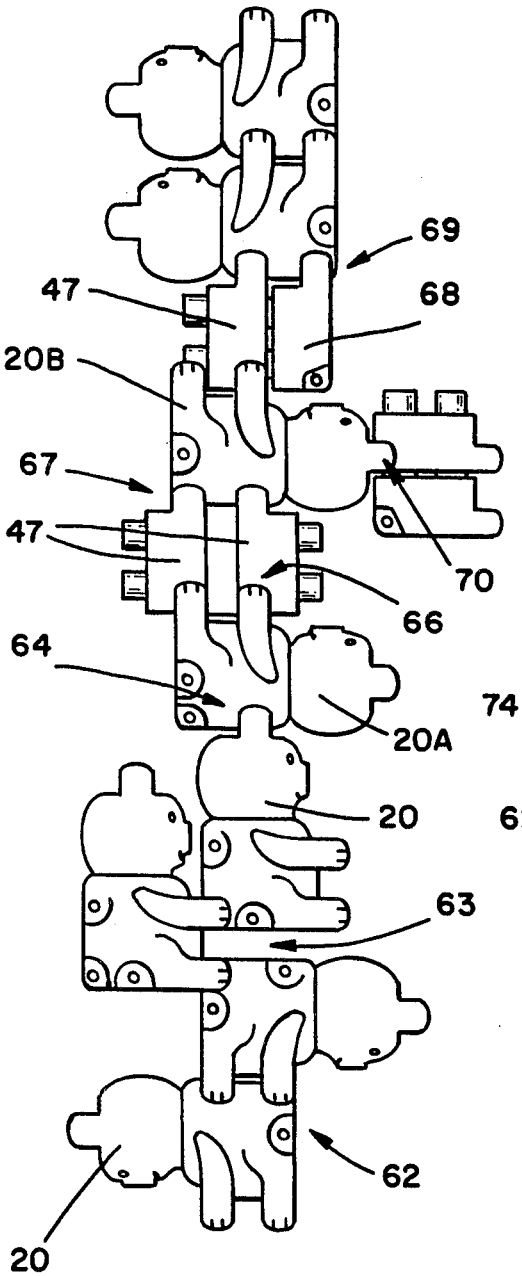
FIG. 12 is a side view of a plurality of toy building blocks of the present invention, showing the many ways in which the blocks may be interconnected.
Figure 13:
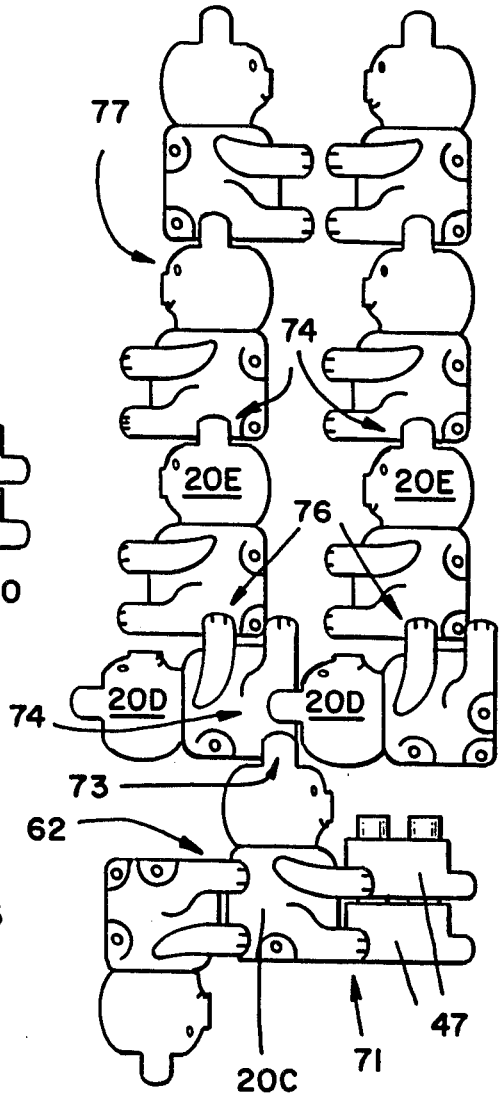
FIG. 13 is another side view of a plurality of toy building blocks of the present invention, showing further ways in which the blocks may be interconnected.

With regard to FIGS. 12 and 13, there is shown a plurality of modes of interconnection of two or more blocks, in an attempt to depict an exemplary, but not exhaustive catalog of interconnection modes of the blocks 20 and blocks 47. At the lower end of FIG. 12, a pair of blocks 20 is connected at 62 in end adjacent fashion, detent arms 30 and 31 joined to recesses 36 and 37, respectively, to form a rigid, upside down connection. A block may also interconnect two other blocks 20 by engaging the arms 31 to the recesses 36 of one block and the arms 30 to the recesses 36 of the other block, as shown at 63. The "ears" 39 of a block 20 may pivotally engage any of the paired detent recesses of another block 20, such as the recesses 37, as shown at 64.

A block 20A may also interconnect two other blocks 47 or the like, as shown at 66 and 67. The two pairs of arms 30 and 31 of one block 20 may engage the recesses 33 of two blocks 47, as shown at 66, or the two arms 29 of two blocks 47 may engage the two pairs of recesses 36 and 37 of one block 20B, as shown at 67. The arms 30 of the block 20B are engaged with the recesses 33 of a single block 47, shown at 68, and two blocks 47 stacked together may have their two pairs of detent arms engaged in both pairs of recesses 36 and 37, as shown at 69. Also, the "ears" 39 may engage the recesses of a block 47 in pivoting fashion, as shown at 70.

With regard to FIG. 13, a block 20C has each pair of arms 30 and 31 connected to different blocks 47 assembled in stacked fashion. The "ears" of block 20C are snap-engaged in pivoting fashion with the recesses 36 of one block 20D. Two blocks 20D are joined in top-to-bottom fashion with the "ears" 39 of one engaged in the recesses 38 of the other. The arms 30 of each block 20D are engaged in the recesses 38 of separate blocks 20E in front-to-bottom fashion shown at 76. Vertical stacks of blocks may be formed by the connections 74, as shown, or the vertical stacks may be varied with adjacent blocks joined in opposite facing directions, as shown at 77.

Thus it may be appreciated that the block construction of the present invention provides a wealth of modes of interconnection, both fixed and rotatable. The outer configuration of the block in an appealing quadriped animal form further enhances the attractiveness of a single block and the assembled blocks. Furthermore, the presentation of the detent arms of the invention as the limbs of the fanciful animal representation is a synergistic combination of function and design not found in other building block systems.

I claim:

1. A toy building block construction, comprising;

a lower body portion having a generally rectangular conformation, an upper body portion integrally formed therewith and having a generally oblate conformation, first and second pairs of detent arms extending from said lower body portion in parallel opposition, a third pair of detent arms extending from said upper body portion in parallel opposition, each of said detent arms including a detent knob formed on an interior surface thereof in confronting relationship with the respective paired detent arm.

2. The toy building block construction of claim 1, further including a plurality of detent recesses disposed in said block in opposed, paired relationship and adapted to receive a detent arm of a like-formed block, each detent recess including a detent depression formed therein and dimensioned to snap-engage the detent knob of the respective detent arm received in the detent recess in freely pivoting fashion.

3. The toy building block construction of claim 2, wherein one pair of said detent recesses in disposed in a lower edge portion of said side walls adjacent to one end wall, and a second pair of detent recesses is disposed in an upper edge portion of said side walls adjacent to said one end wall.

4. The toy building block of claim 3, further including a third pair of said detent recesses disposed in a lower medial portion of said side walls adjacent to the lower edge thereof.

5. The toy building block construction of claim 1, further including a plurality of socket-like receptacles formed in an array in the bottom surface of said lower body portion and disposed to engage cylindrical projections formed in a similar array and extending from another building block.

6. A toy building block construction, comprising;

a lower body portion having a generally rectangular conformation, an upper body portion integrally formed therewith and having a generally oblate conformation, first and second pairs of detent arms extending from said lower body portion in parallel opposition, a third pair of detent arms extending from said upper body portion in parallel opposition, each of said detent arms including a detent knob formed on an interior surface thereof in confronting relationship with the respective paired detent arm, wherein said first and second pairs of detent arms are arrayed as the limbs of a quadruped animal, and said third pair of detent arms is disposed as the ears of the animal.

7. The toy building block of claim 6, further including surface relief features formed in said side walls contiguously with said first and second pairs of detent arms and having the conformation of limb portions of an animal.

8. The toy building block of claim 7, further including surface relief features formed in said upper body portion and configured as the face of an animal.

9. A toy building block construction, comprising;

a block body, a plurality of pairs of detent arms extending from said body, a plurality of pairs of detent recesses formed in said body, each pair of detent recesses disposed to receive one of said pairs of detent arms of a like-formed block in complementary fit fashion, and snap-engaging means for joining said detent arms and said detent recesses in snap-engaging, releasable fashion, said block body including surface conformation means having features of an animal, futher including an upper body portion joined to said block body, said surface conformation means including head and face features on said upper body portion, said plurality of pairs of detent arms include at least two pair of detent arms extending from said block body in parallel opposition and disposed as the limbs of a quadruped animal, and said plurality of pairs of detent arms includes one pair of detent arms extending from said upper body portion and disposed as the ears of an animal.

10. A toy building block construction, comprising;

a block body including at least a front surface and a top surface and opposed sides, a plurality of pairs of detent arms extending from said body, including at least one pair of detent arms extending outwardly from said front surface at opposed sides thereof, and one pair of detent arms extending outwardly from said top surface at opposed sides thereof, said front surface and said top surface being non-parallel and non-intersecting, a plurality of pairs of detent recesses formed in said body, each pair of detent recesses disposed to receive one of said pairs of detent arms of a like-formed block in complementary fit fashion, and snap-engaging means for joining said detent arms and said detent recesses in snap-engaging, releasable fashion.

11. A toy building block construction, comprising;

a block body, said block body including a main body portion, an upper body portion, and a neck portion joining said upper body portion and said main body portion, said neck portion being relatively narrower than said upper body and main body portions, a plurality of pairs of detent arms extending from said block body, including a first pair of detent arms extending from said main body portion, a second pair of detent arms extending from said upper body portion and disposed non-parallel to said first pair of detent arms, a plurality of pairs of detent recesses formed in said main body portion, each pair of detent recesses disposed to receive one of said pairs of detent arms of a like-formed block in complementary fit fashion, and snap-engaging means for joining said detent arms and said detent recesses in snap-engaging, releasable fashion.

12. The toy building block construction of claim 11, further including a plurality of socket-like receptacles formed in an array in a lower surface of said main body portion and disposed to engage cylindrical projections formed in a similar array and extending from another building block.

13. The toy building block construction of claim 11, wherein said main body portion includes a pair of opposed end walls and side walls extending therebetween, said end walls being substantially planar.

14. The toy building block construction of claim 13, wherein said plurality of pairs of detent recesses include one pair disposed in parallel opposition in the lower edge portion of said side walls adjacent to the second end wall opposite said one end wall, and another pair of recesses disposed in parallel opposition in an upper portion of said side walls adjacent to said second side wall.

15. The toy building block construction of claim 14, wherein said plurality of pairs of detent recesses further includes a third pair of detent recesses disposed in parallel opposition in lower medial portions of said side walls adjacent to the lower edge thereof.

* * * * *